US005713559A

United States Patent [19]

McClarin et al.

[11] Patent Number: 5,713,559

[45] Date of Patent: Feb. 3, 1998

[54] METHOD AND APPARATUS FOR INSTALLING AND REMOVING POSTS AND FOR LIFTING HEAVY OBJECTS

[75] Inventors: Daniel C. McClarin, La Luz; Neil Dean Ochoa, Alamogordo, both of N. Mex.

[73] Assignee: McClarin Manufacturing, Inc., La Luz, N. Mex.

[21] Appl. No.: 650,687

[22] Filed: May 20, 1996

Related U.S. Application Data

[63] Continuation-in-part of Ser. No. 197,275, Feb. 16, 1994, abandoned.

[51] Int. Cl.[6] ..... B66F 3/22

[52] U.S. Cl. ..... 254/124; 254/131; 254/129; 254/130; 254/30; 254/DIG. 3; 254/DIG. 4

[58] Field of Search ..... 254/30, 120, 129, 254/130, 131, DIG. 3, DIG. 4, 133 R

[56] References Cited

U.S. PATENT DOCUMENTS

| | | | |
|---|---|---|---|
| 655,909 | 8/1900 | Nebel et al. | 294/92 X |
| 1,234,243 | 7/1917 | Williams | 254/131 |
| 1,409,377 | 3/1922 | Hendry | 254/DIG. 3 |
| 1,916,463 | 11/1933 | Carrel | 254/132 |
| 2,201,394 | 5/1940 | Edelblute | 254/131 |
| 2,532,533 | 12/1950 | Baldwin et al. | 254/121 |
| 2,655,399 | 10/1953 | McMillan | 254/131 |
| 2,777,726 | 3/1957 | Lundgren et al. | 254/132 |
| 3,848,850 | 11/1974 | Bemis | 254/30 |
| 3,861,649 | 1/1975 | Mosley | 254/124 |
| 3,991,976 | 11/1976 | Skinner | 254/131 |
| 4,250,769 | 2/1981 | Herring | 254/129 |
| 4,261,548 | 4/1981 | Kaderabek | 254/131 |
| 4,365,786 | 12/1982 | Osteen | 254/130 |
| 4,365,925 | 12/1982 | Girtz | 254/131 |

FOREIGN PATENT DOCUMENTS

| | | | |
|---|---|---|---|
| 27121 | 1/1955 | Finland | 254/120 |

OTHER PUBLICATIONS

"Mother's Fencepost Puller", The Mother Earth News–p. 90 Mar./Apr. 1979.

Brochures, Harper Tool, Inc., for Yankease™ Post Puller (date unknown).

E–Z Wire Roller and Unroller Brochure, E–Z Products, a Division of Sheets, Inc., High Plains Publishers, Inc., Dodge City, Kansas (date unknown).

T–Post Popper, Model 1400, Tri–L Manufacturing, Inc. (date unknown).

Pull–A–Post Brochure, Model PUL–100, Tri–L Manufacturing, Inc. (date unknown).

Steel Post Puller Broshure, Model P–294, Manufacturing Systems, Inc. (Nov. 1993).

Advertisement in Farm Show regarding T–Post Puller manufactured by U.S. Lever Industries, Newalla, Oklahoma (date unknown).

Advertisement for HO–1000 T–Post Puller manufactured by U.S. Lever Industries, Newalla, Oklahoma (publication date unknown).

Advertisement for FL3000 T–Post Puller manufactured by U.S. Lever Industries, Newalla, Oklahoma (publication date unknown).

Advertisement for Stake Puller by Burk (publication date unknown).

*Primary Examiner*—Robert C. Watson
*Attorney, Agent, or Firm*—Dennis F. Armijo

[57] ABSTRACT

A post/stake removing tool with at least two base support angles from the ground for the fulcrum lever to pull on the post/stake near or at the angle the post/stake are inserted. The fulcrum is pivotably attached to the support and the jaw is pivotably attached to the lever arm. The jaw is a diamond shaped aperture for grabbing the post/stake in four places. A fulcrum/lever is also used to remove heavy or stuck manhole covers. A combination hook and jack lifting head apparatus is attached to the lever arm for manual use or for lifting with a jack.

(List continued on next page.)

7 Claims, 13 Drawing Sheets

U.S. PATENT DOCUMENTS

| | | | |
|---|---|---|---|
| 4,726,565 | 2/1988 | Keller | 254/30 |
| 4,738,433 | 4/1988 | Hoff | 254/30 |
| 4,746,098 | 5/1988 | Abarotin | 254/130 |
| 4,750,711 | 6/1988 | Landry | 254/30 |
| 5,009,394 | 4/1991 | Marshall | 254/30 |
| 5,011,117 | 4/1991 | Youngblood et al. | 254/30 |
| 5,022,632 | 6/1991 | Beideck | 254/132 |
| 5,161,781 | 11/1992 | Sohocki | 254/30 |
| 5,186,437 | 2/1993 | Scott | 254/30 |
| 5,529,287 | 6/1996 | Pelosi, Jr. et al. | 254/129 |

METHOD AND APPARATUS FOR INSTALLING AND REMOVING POSTS AND FOR LIFTING HEAVY OBJECTS

CROSS-REFERENCE TO RELATED APPLICATION

This appllication is a continuation-in-part application of U.S. patent application, Ser. No. 08/197,275, filed Feb. 16, 1994, now abandoned, entitled "Method And Apparatus For Installing And Removing Posts", the teachings of which are incorporated herein by reference.

BACKGROUND OF THE INVENTION

1. Field of the Invention (Technical Field)

This invention relates generally to lifting devices and, in particular, to a lifting device for removing and replacing posts, manhole covers and other heavy objects.

2. Background Art

Farms, ranches, backyard gardens, construction sites, commercial businesses often require installation and removal of posts and stakes for such things as fencing, markers, tents signs. Posts and stakes are a necessary component of such activities. One common method of installing fence posts involves driving posts into the earth's surface with a sledge hammer. This method can lead to injury to the installer and damage to the post. Another method is to excavate a hole of proper size, install the post within the hole, and then backfill the remaining void. Such a method is time consuming and often leaves the post unstable. Along with the need for ease of installation comes the need to easily remove the installed post or stake for repositioning and relocation. Many apparatuses that are currently in use for removing posts and stakes include prybars. Use of a prybar often bends or otherwise damages the post or stake and can lead to back injury for the party removing the post. Other existing devices grasp the post and employ a lever and fulcrum to remove the post or stake from the ground. However, such devices often inadequately grip the post allowing for slippage, which can cause injury and frustration. Further, when such devices adequately grip the post substantial damage may be inflicted to the post during removal.

Manhole covers are presently placed and removed manually. This process for placement and removal subjects the person who handles the manhole covers to injuries, especially for heavier manhole covers or when the cover is stuck. Again, prybars are used for these applications as well as sledge hammers or hydraulic lifts on tractors for stuck manhole covers, which is inefficient, expensive and time consuming.

SUMMARY OF THE INVENTION (DISCLOSURE OF THE INVENTION)

The present invention comprises a method and apparatus for installing and removing posts and for lifting and replacing heavy objects such as manhole covers.

The preferred post removing tool comprises a base with at least two fulcrum support affixing apparatuses wherein said at least two fulcrum support affixing apparatuses comprise a first fulcrum support affixing apparatus at a first angle from the ground and a second fulcrum support affixing apparatus at a second angle from the ground, a fulcrum support, a fulcrum pivotally affixed to the fulcrum support, an adjustable lever arm affixed to the fulcrum and a jaw for gripping the post pivotably affixed to an end of the lever arm.

The invention can further comprise a third fulcrum support affixing apparatus at a third angle from the ground. The preferred fulcrum support is slidably insertable into one of the at least two support affixing apparatuses. The preferred adjustable lever arm is slidably insertable into the fulcrum. The invention further comprises a lever arm extension. The preferred jaw comprises a four sided shaped aperture. The preferred four sided shaped aperture comprises a rectangle.

The preferred apparatus for lifting manhole covers and other heavy items comprises a base, a fulcrum support affixed to the base, a fulcrum pivotably affixed to the fulcrum support, an adjustable lever arm affixed to the fulcrum and a combination hook and jack lifting head receiving apparatus affixed to a first end of the lever arm. The preferred lever arm is slidably insertable into the fulcrum. The preferred combination hook and jack lifting head receiving apparatus comprises a lifting hook on a first side and the jack lifting head receiving apparatus on a second side. The preferred jack lifting head receiving apparatus comprises a cup for receiving a hydraulic jack lifting head. The invention can further comprise a second jack lifting head receiving apparatus affixed to a second end of the lever arm. The invention can further comprise at least one lever arm extension. The preferred at least one lever arm extension comprises a telescopic lever arm extension. The invention can further comprise a "T" handle affixed to the lever arm.

The jaw for use with a post removing tool comprises a plate comprising a diamond shaped aperture and an apparatus for pivotably affixing the plate to a post removing tool lifting apparatus. The preferred diamond shaped aperture comprises a four sided aperture. The preferred four sided aperture comprises a rectangle. The invention can further comprise a slot shaped aperture from a corner of the diamond shaped aperture to an end of the plate for insertion of a "T" post. The preferred apparatus for pivotably affixing the plate to a post removing tool lifting apparatus comprises a first strap and second strap permanently affixed to the plate and strap apertures in the first strap and the second strap for insertion of a restraining pin through the strap apertures and through apertures in the post removing tool lifting apparatus.

A primary object of the present invention is the provision of a universal post removing tool capable of removing different types of posts and stakes.

Another object of the invention is the provision of a manhole cover remover capable of removing stuck or heavy manhole covers.

Still another object of the invention is the provision of a jaw for removing posts or stakes that wedges into the post or stake in at least four different places.

A primary advantage of the present invention is its versatility for use in several different applications.

Another advantage of the invention is its safety compared to other known devices.

Yet another advantage of the invention its low cost and ease of manufacture.

Still another advantage of the invention is that the component parts are constructed to fold or telescope making it compact, easy to store and transport.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
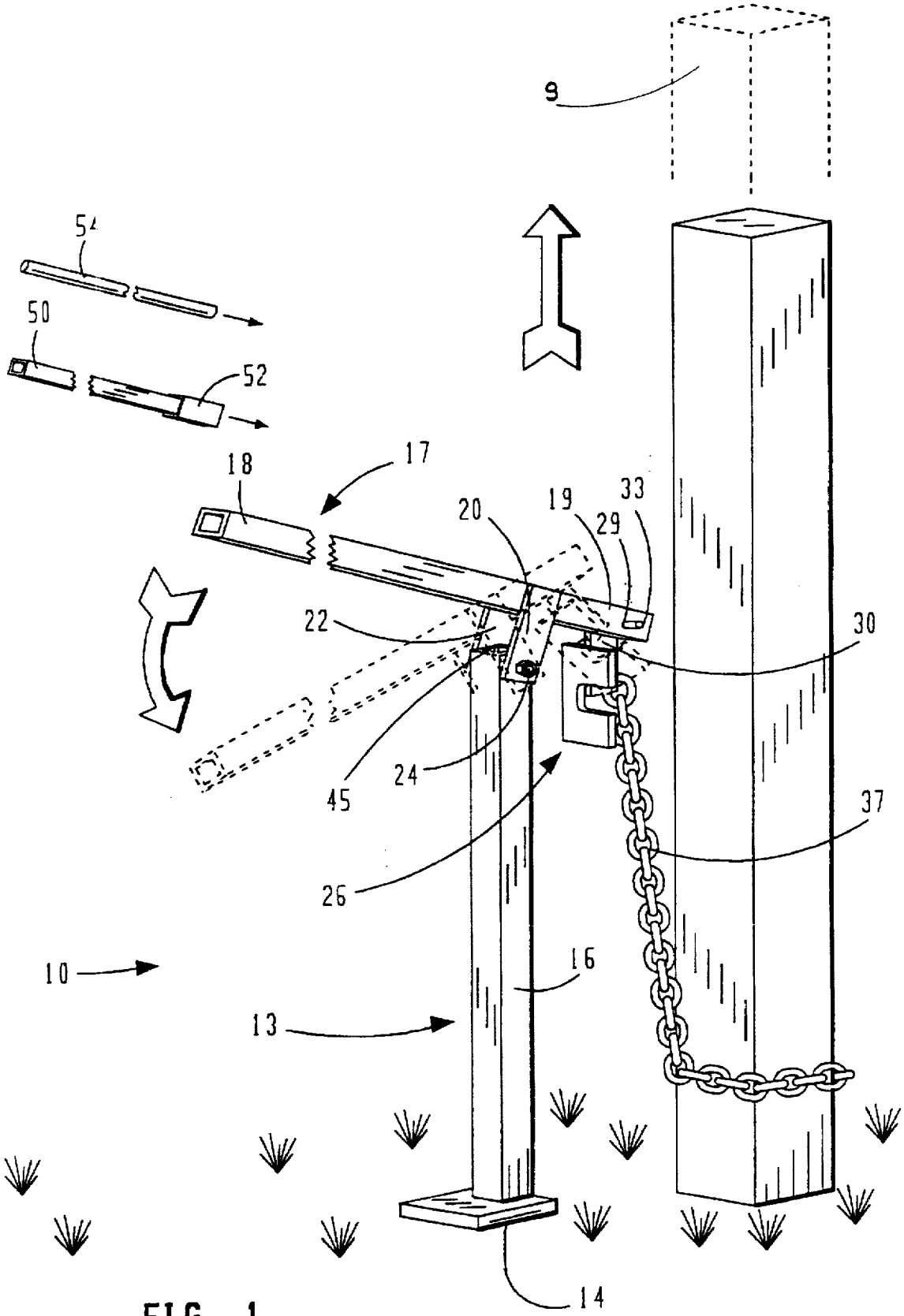
FIG. 1 is a perspective view of an alternative embodiment of the post puller of the present invention utilizing a chain.

The removal of fence posts, grounding rods, tent stakes and similar devices is a problem faced by several individuals, especially in construction or on farms. Additionally, manhole cover removal poses several problems especially when the manhole covers weigh hundreds of pounds or are stuck because they are frozen, rusted or wedged in place. The present invention is a hand tool specially designed for these purposes. FIG. 1 of the drawings is a perspective view of the present alternative invention comprising an apparatus 10 for installing and removing posts. The apparatus 10 includes a fulcrum stand, generally referred to as 13, having a horizontal base plate 14 rigidly connected to an upwardly extending hollow support member 16. The apparatus 10 further includes an elongated lever 17 having a handle end 18 and a lifting end 19. Lever 17 may be extended by means of tubular lever extension 50 and lever connector 52 or alternative lever extension bar 54. Positioned between the handle and lifting ends 18 and 19, and more proximate to the lifting end 19, are two downwardly extending brackets 20 and 22 which are pivotally connected to the upwardly extending hollow support member 16 of the fulcrum stand 13 by a pin 24. Downwardly extending brackets 20 and 22 have a predetermined length for displacing pivot pin 24 from lever 17 into a folded position parallel with and proximally adjacent to fulcrum stand 13, thereby providing for compact storage and ease of transportation.

Figure 3:
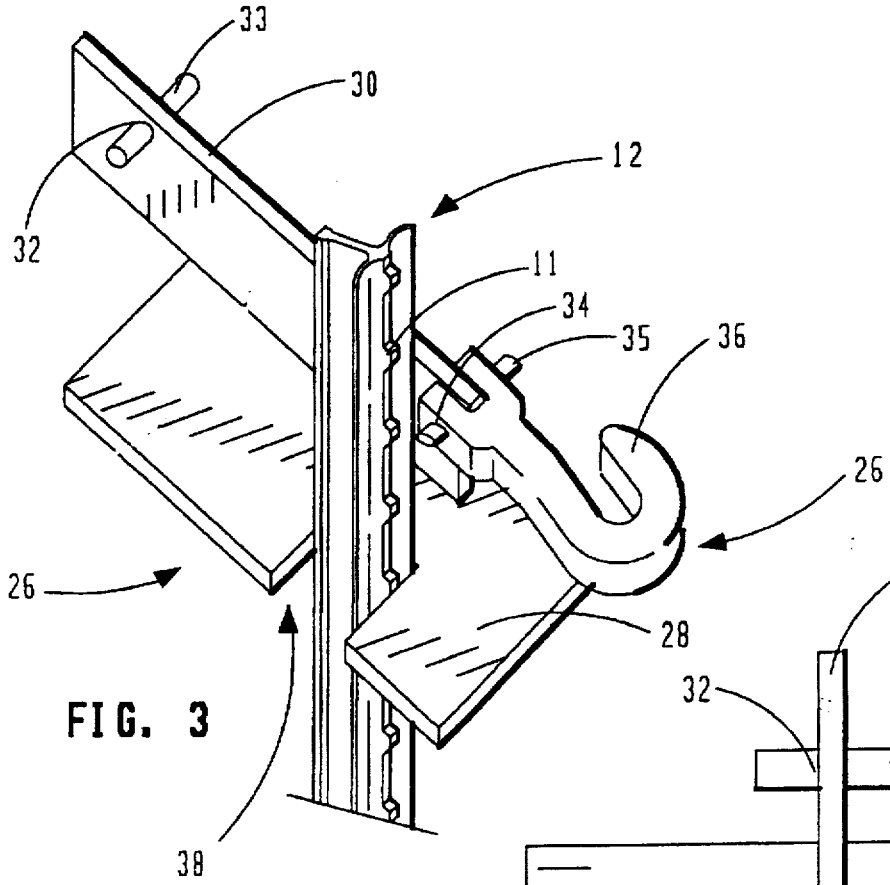
FIG. 3 is s an enlarged perspective view illustrating the "C" shaped jaw illustrated in FIG. 2.
Figure 4:
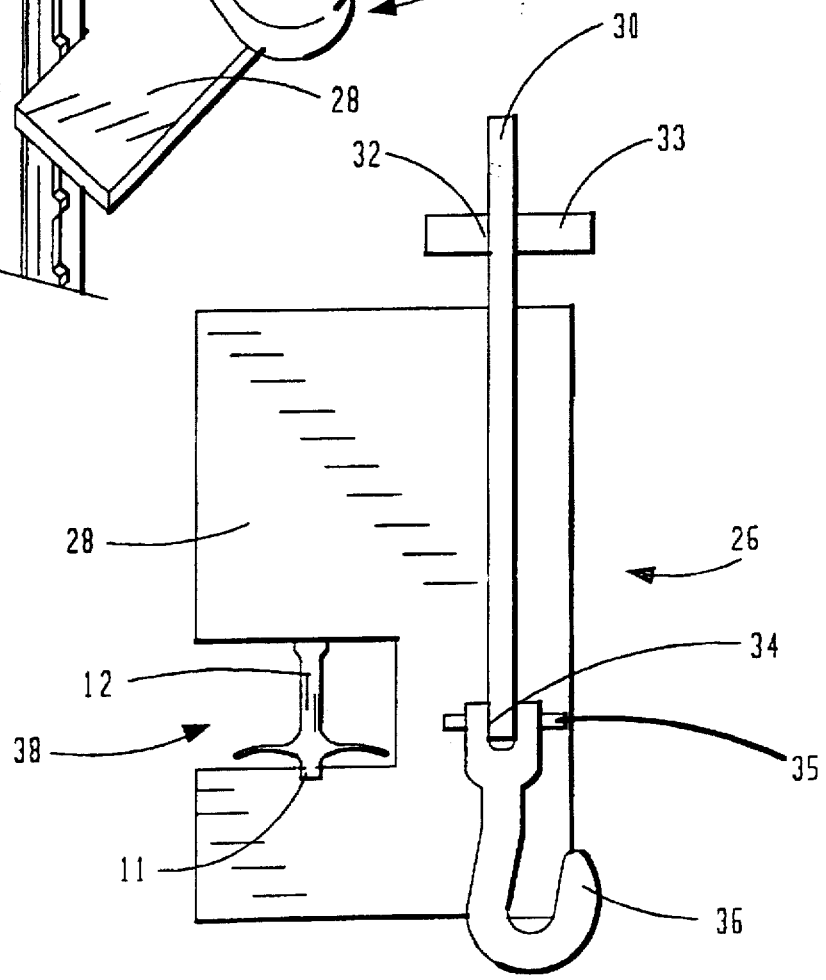
FIG. 4 is an enlarged top view illustrating the "C" shaped jaw illustrated in FIG. 2.
Figure 5:
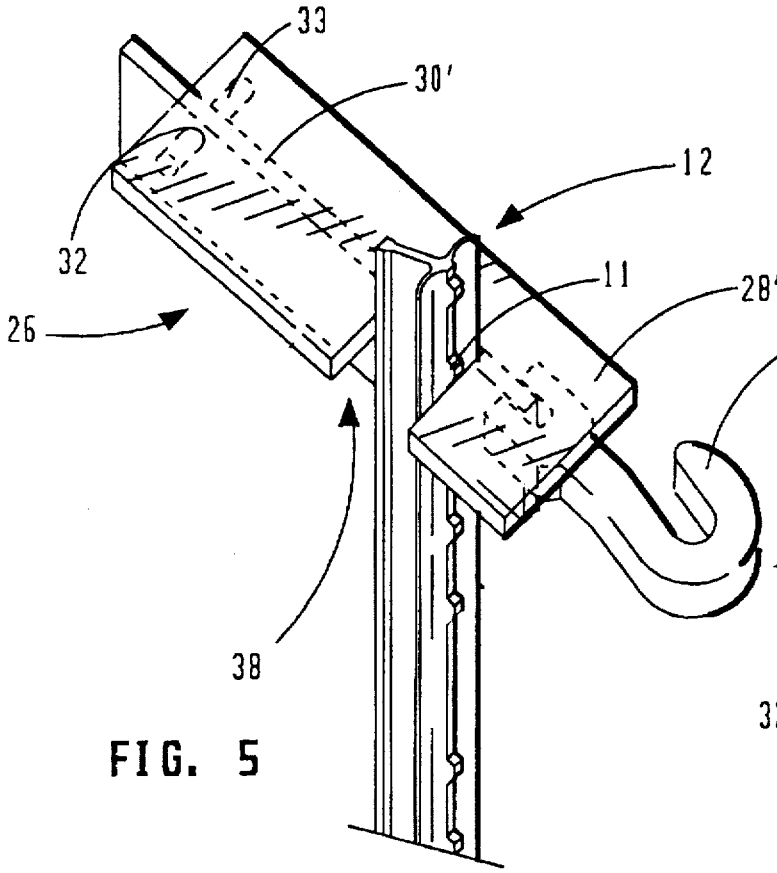
FIGS. 5 and 6 are enlarged top views illustrating alternative embodiments of the jaw illustrated in FIG. 2.
Figure 6:
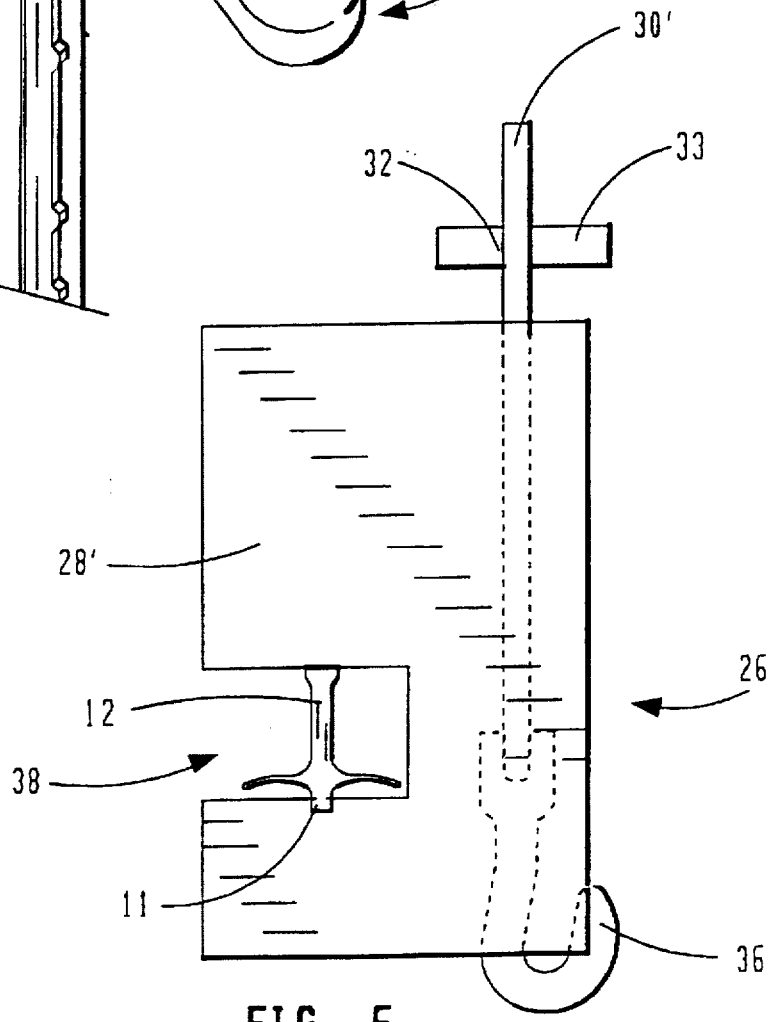

The apparatus 10 further includes a post gripping means 26, connected to the lifting end 19 of lever 17 by means of pin 33 inserted through a circular opening 29 in lever 17. An alternative post gripping means 26, shown in more detail in FIGS. 3, 4, 5 and 6, include a substantially "C" shaped receiving plate 28 and slot 38. The slot 38 is sized to receive a standard size metal studded "T" post 12, and to engage one of the raised studs 11 dispersed along the length of "T" post 12 (see FIG. 2). FIGS. 3 and 4 show a connector plate 30 rigidly connected to the top side of receiving plate 28. The connector plate 30 has two circular openings 32 and 34. The first opening 32 is for receiving a pin 33 to rotatably mount post gripping means 26 to the lifting end 19 of lever 17 in opening 29 (See FIG. 2). The second opening 34 is for receiving a pin 35 and standard grab hook 36. FIGS. 5 and 6 illustrate an alternative embodiment wherein the connector plate 30' is rigidly connected to the bottom side of receiving plate 28'. Other components comprising the alternative embodiment function substantially the same as the components shown in FIGS. 3 and 4 are denoted with like numerals. A heavier duty embodiment wherein two connector plates are rigidly connected to the bottom side of receiving plate is not shown.

Figure 7:
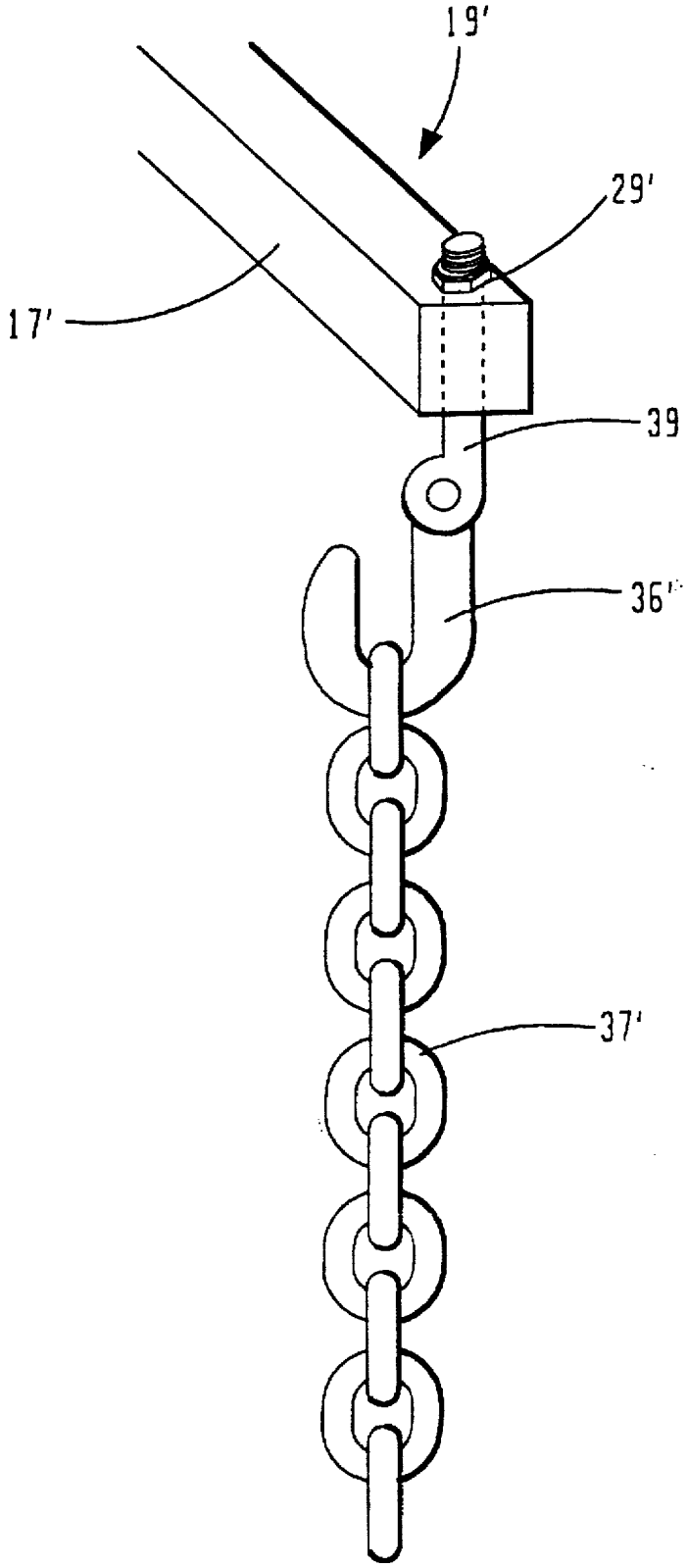
FIG. 7 is an enlarged perspective view of an alternative embodiment of the present invention illustrating a hook and chain grappling mechanism.

Reference is now made to FIG. 7 wherein there is shown an alternative embodiment useful for using a chain to remove posts or for lifting other heavy objects. Instead of the post gripping means 26 (as shown in FIGS. 3, 4, 5 and 6) a standard grab hook 36' is connected to the lifting end 19' of lever 17' by means of a pin 39 placed into opening 29'.

Figure 8:
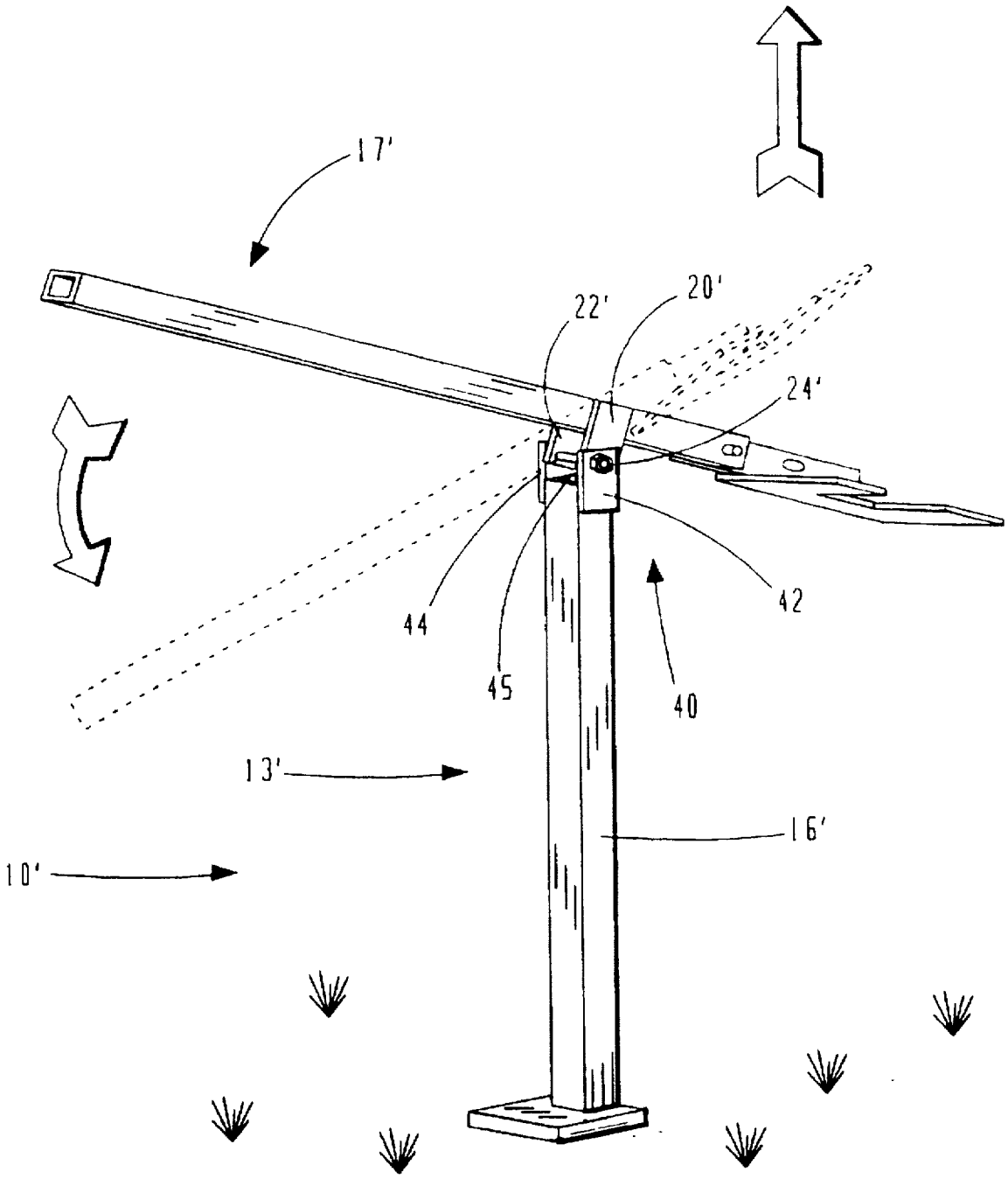
FIG. 8 is a perspective view of an alternate embodiment of the post puller of the present invention illustrating a modified pivotal connection between the lever and fulcrum stand.

Reference is now made to FIG. 8 wherein there is shown a heavier duty embodiment of apparatus 10' useful for removing posts from rock and soil conditions in which more upward force is necessary to remove the post. The metal used to form the level 17' and upwardly extending hollow support member 16' of fulcrum stand 13' is preferably of heavier weight and grade or of larger diameter and cross-sectional area than in the standard embodiment of FIG. 1. Furthermore, the apparatus 10' includes an enhanced pivoting connector 40 attached to fulcrum stand 13'. The enhanced connector 40 comprises a pair of upwardly extending receiving brackets 42 and 44 rigidly attached on opposite sides, and at the open upper end 45 of fulcrum stand 13'. Receiving brackets 42 and 44 are spaced to receive the downwardly extending brackets 20' and 22' of lever 17' there between. Removable pin 24' pivotally connects lever 17' to fulcrum stand 13'. Downwardly extending brackets 20' and 22' have a predetermined length for displacing pivot pin 24' from lever 17' in order that the lever 17' may rotate about pivot pin 24' into a folded position parallel with and proximally adjacent to the fulcrum stand 13' thereby providing for compact storage and ease of transportation.

The apparatus of the present invention may be used to remove a post from the ground by three different methods. In the first method, shown in FIG. 1, post gripping means 26 is allowed to pivot downward and a standard grab hook 36 is connected to the connector plate 30 with a pin 35 in opening 34 (FIGS. 3 and 4). One end of lifting chain 37 is secured in grab hook 36 and the other end of the lifting chain 37 is wrapped and secured around post 9. As the handle end 18 of lever 17 is moved downward, the downward force applied to lever 17 is transformed into an upward force by the fulcrum stand 13. The upward force is then transferred via the post gripping means 26 and the lifting chain 37 to the post 11 to move the post upward from the earth's surface. When the handle 18 is moved to its lowermost position, the lifting chain 37 is loosened from the post, the handle is repositioned to its uppermost position and the chain is re-secured around the base of the post in preparation for another cycle. This "jacking" operation is repeated as many times as is necessary to remove the post from the ground.

Figure 2:
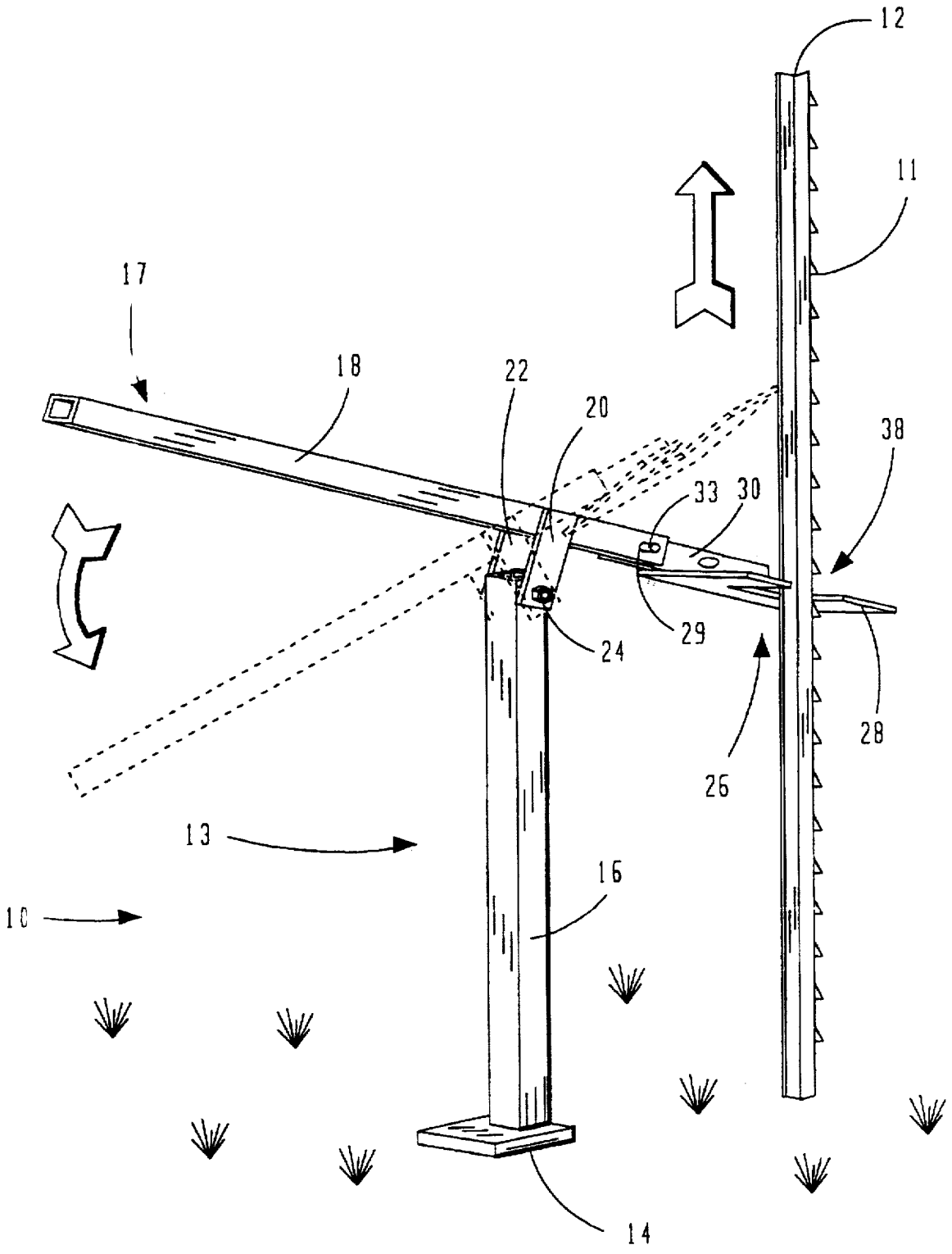
FIG. 2 is a perspective view of an alternative embodiment of the post puller of the present invention with a "C" shaped jaw.

In the second method, illustrated in FIG. 2, the slot 38 of the post gripping means 26 receives the metal "T" post 12 with the edges of slot 38 engaging one stud 11 thereon. As the handle end 18 of the lever 17 is moved downward, the downward force applied to lever 17 is transformed into an upward force by fulcrum stand 13. The upward force is then transferred via the post gripping means 26 to the metal "T" post 12. The post gripping means 26 is then disengaged from the metal "T" post 12. The handle 18 is raised to its uppermost position and the post gripping means is repositioned to engage another stud 11 on the "T" post 12, and the cycle is repeated. The open "C" shaped configuration allows for quick repositioning of the apparatus 10 during the jacking operation.

Alternatively, in a third method of operation, illustrated in FIG. 7, a standard grab hook 36' and lifting chain 37' is attached on the lifting end 19' of lever 17'. The other end of lifting chain 37' is attached to the object to be lifted (not shown).

Figure 9:
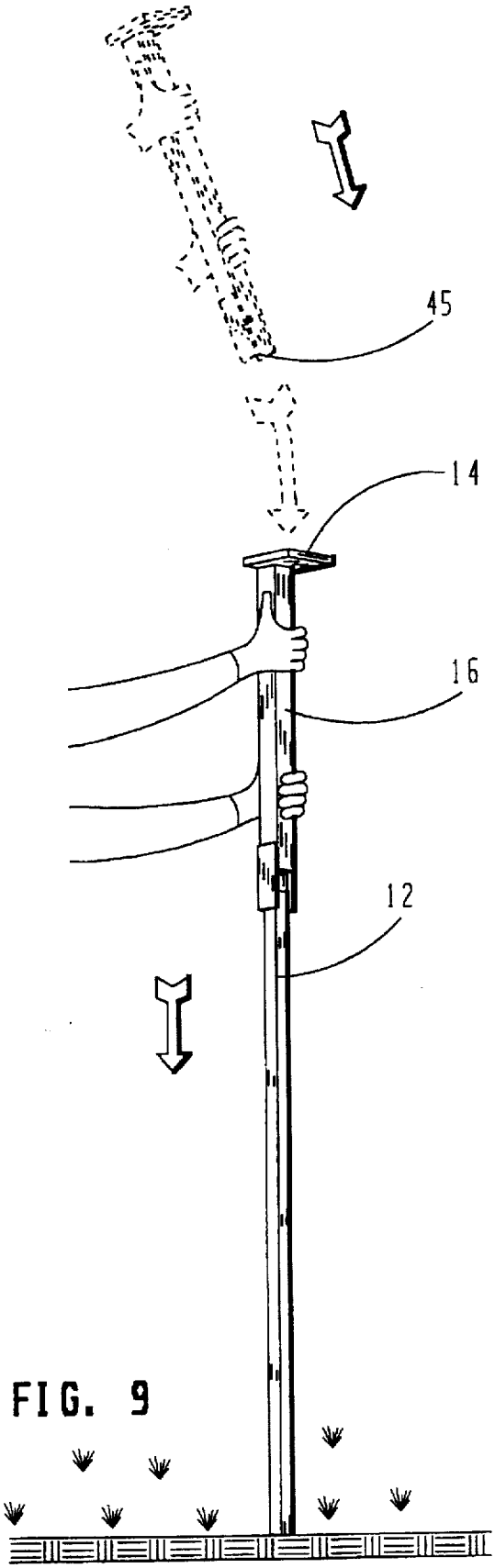
FIGS. 9 and 10 illustrate the use of the post puller of the present invention to install posts into the earth's surface.
Figure 10:
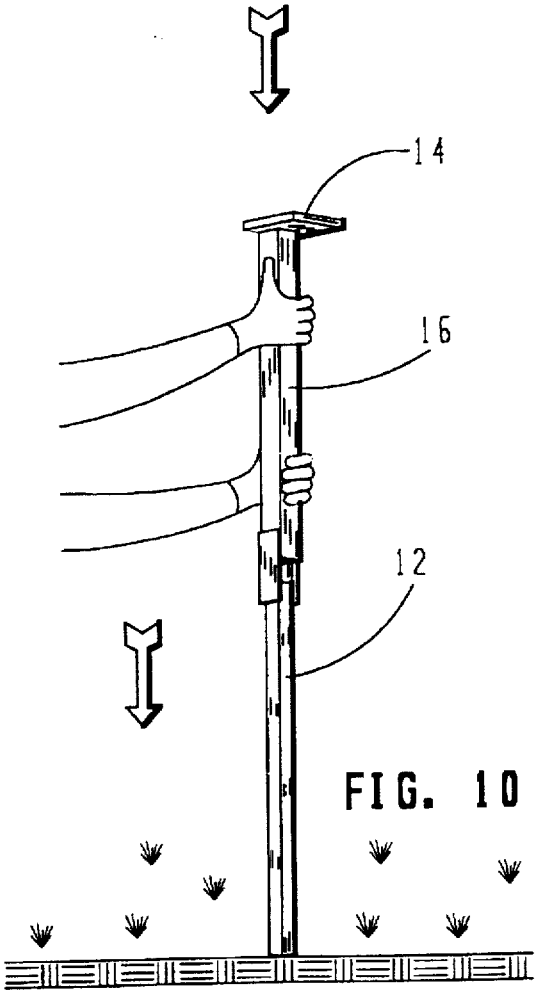

Apparatus 10 may also be used for installing as well as removing posts. FIGS. 9 and 10 illustrate a method for installing metal posts using the apparatus 10. Connector pin 24 and lever 17 are removed from fulcrum stand 13. The hollow support member 16 is inverted and held upright with the base plate 14 on top. The open end 45 of the support member 16 is cross sectionally dimensioned to receive "T" post 12. Hollow support member 16 is raised and lowered, swallowing "T" post 12, thereby allowing the base plate 14 to strike the top end of "T" post 12 and drive it into the earth's surface. The smooth surfaces of hollow support member 16 avoids blisters on the user's hands. Momentum created by the downward movement of the entire inverted fulcrum stand 13 provides additional driving force. Alternatively, the hollow support member is axially disposed over the "T" post 12 and force is applied directly to the base plate 14 with the sledge hammer or other driving means to install the post in the earth's surface.

Fulcrum stand 13 and lever 17 can be folded together for compact storage and easy transportation. In some embodiments the hollow support member and lever 17 have hooks attached for receiving a sling apparatus (not shown). The hooks and sling apparatus allow the entire apparatus 10 to be carried on a person's back and/or carried horseback over rugged terrain.

Figure 11:
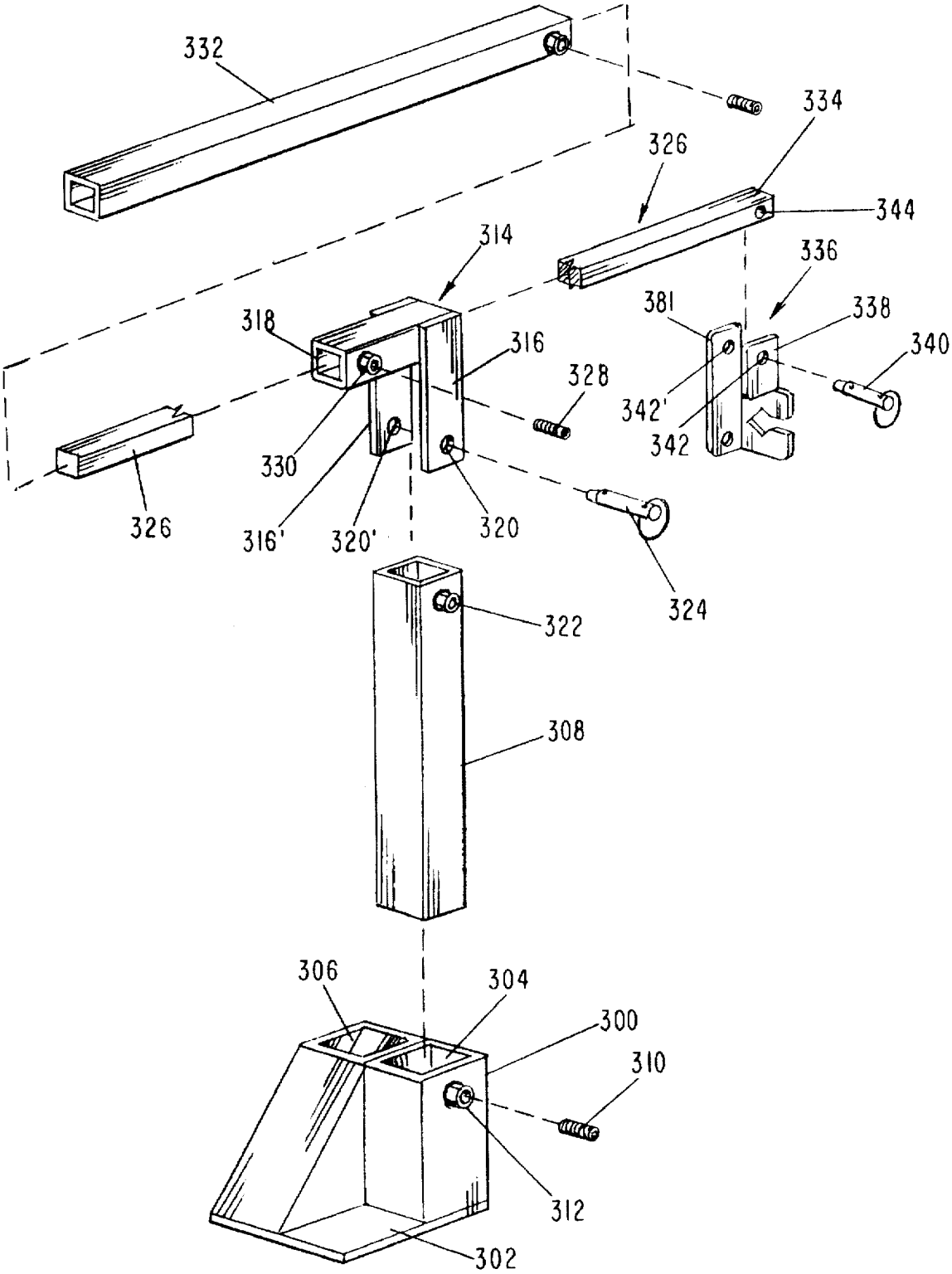
FIG. 11 is a perspective view of the preferred embodiment of the post or stake puller.
Figure 12:
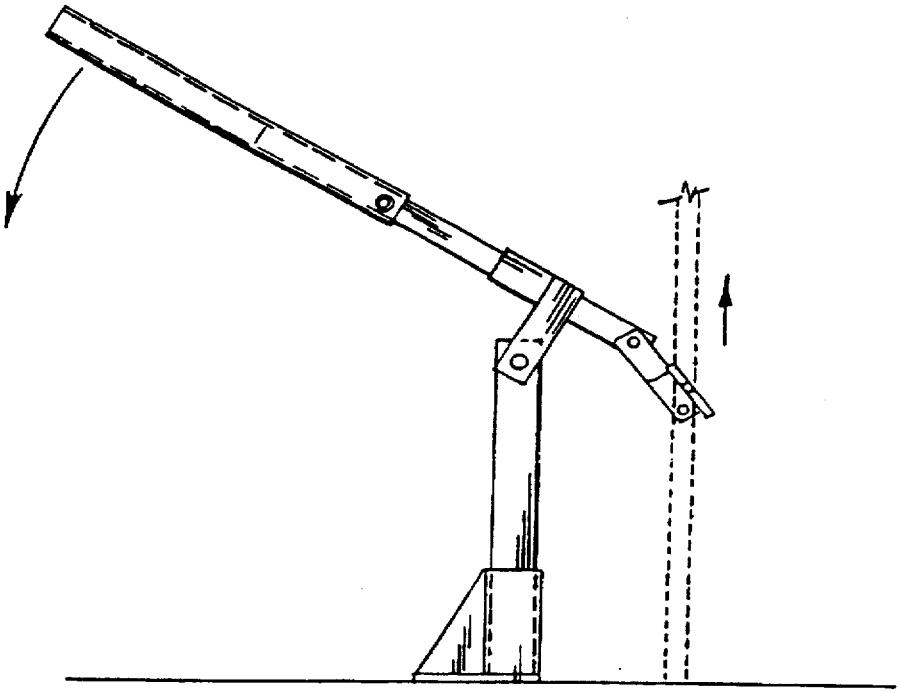
FIG. 12 illustrates the preferred embodiment in removing a post inserted at approximateley 90° to the suraface.
Figure 13:
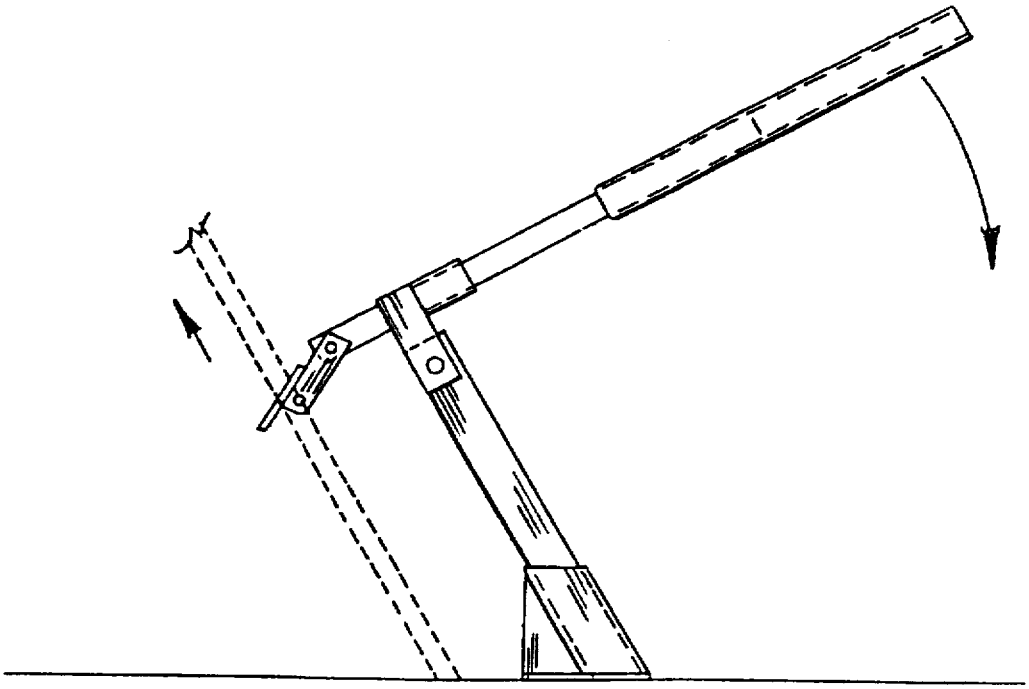
FIG. 13 illustrates the preferred embodiment in removing a post inserted at approximateley 45° to the surface.

The preferred post or stake removing tool is shown in FIGS. 11, 12 and 13. Each of the component parts are shown in FIG. 11. Base 300 contains base plate 302 which is laid upon the ground surface. In this embodiment two different angles for post or stake removal can be used. Lifting at different angles is accomplished by 90° base support member 304, for removing posts or stakes that are substantially perpendicular to the ground as shown in FIG. 12, or 45° base support member 306 for removal of posts or stakes at substantially 45° from the ground as shown in FIG. 13. Although, a 45° angle from the ground is shown in this embodiment, an angle from 30° to 80° can be used with the preferred range between 40° to 65° from the ground. Although, only two base support members are shown, more base support members can be utilized at other angles, or other angles can be used for the existing base support members. Support riser 308 is slid into the appropriated base support member. To keep support riser 308 in place, base fastening screw 310 is tightened. Although a screw 310 and nut 312 are shown, other known fastening methods can be used. Support riser 308 is of an appropriate length, depending on the use. For instance, for ground rod or stake removal a short support riser 308, such as twelve (12) to eighteen (18) inches can be used. However, for larger stakes or posts a longer support riser 308, such as two a (2) to three (3) foot riser can be used. Attached to support riser 308 is lifting lever 314. Lifting lever 314 preferably contains two pivot attaching tabs 316 and 316' for pivotally attaching lifting lever 314 to support riser 308. Pivot attaching tabs 316 and 316' are preferably welded to hollow lever arm receiver 318 as shown. Lifting lever 314 is lowered onto support riser 308 wherein pivot attaching tab apetures 320 and 320' line up with support riser apeture 322. Pin 324 is inserted as shown so that lifting lever 314 pivots on support riser 308.

Lever arm 326 is inserted into hollow lever arm receiver 318 a distance to achieve optimal performance. Lever arm bolt 328 and nut 330 are used to secure lever arm 326. To increase the amount of leverage, a lever arm extender 332 can be attached to lever arm 326 as shown. Additional extenders can be added as necessary (not shown). Pivotally attached to lifting end 334 of lever arm 326 is jaw 336. Jaw tabs 338 and 338' are welded to jaw 336 as shown so that jaw tabs 338 and 338' fit over lifting end 334 and jaw pin 340 can be inserted through jaw tab apetures 342 and 342' and lifting end apeture 344. An additional hook apeture 345 can be added for attaching a lifting hook for attaching to a chain, or the like (not shown).

Figure 14:
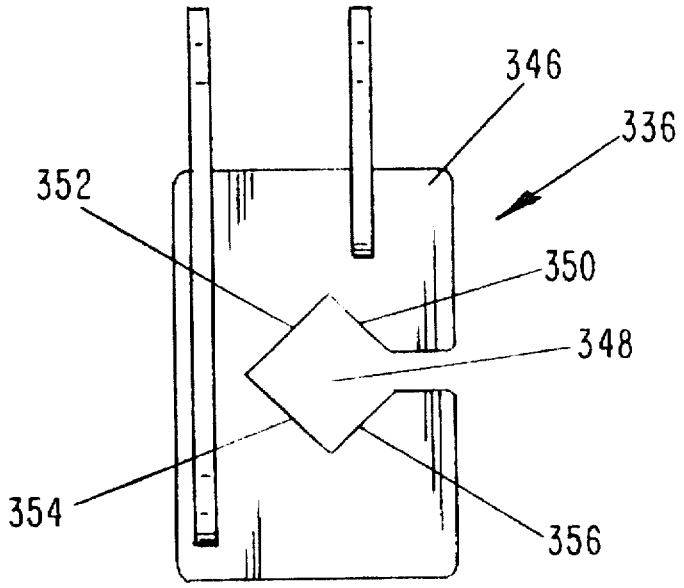
FIG. 14 is a top view of the preferred diamond shaped jaw.
Figure 15:
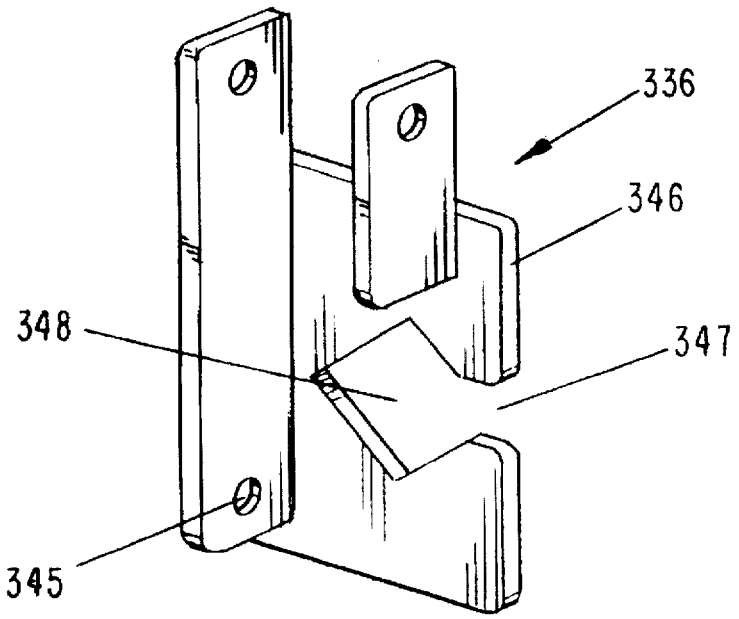
FIG. 15 is a perspective view of the jaw in FIG. 14.

The preferred jaw 336 is shown in FIGS. 14 and 15. Receiving plate 346 contains a four sided or diamond shaped apeture 348 for gripping posts or stakes. The diamond shaped configuration increases the efficiency of the lifting mechanism and decreases the chance for slippage. By using this diamond shaped jaw the post or stake is wedged onto the jaw on four surfaces 350, 352, 354 and 356, instead of only two as shown in the "C" shaped configuration. This jaw configuration is especially efficient for use on round shaped posts or stakes although it can be used for any shape of stake or post. For ease of use, slot 347 can be added as shown in FIG. 15 for use with standard "T" posts. With slot 347 in jaw 336 a user need not slide jaw 336 over the top of the "T" post but can insert jaw 336 onto the side of a "T" post through slot 347. Although only four sides are shown for the diamond shaped jaw, the apeture can have more sides such as a five sided, six sided, etc., (not shown).

Figure 16:
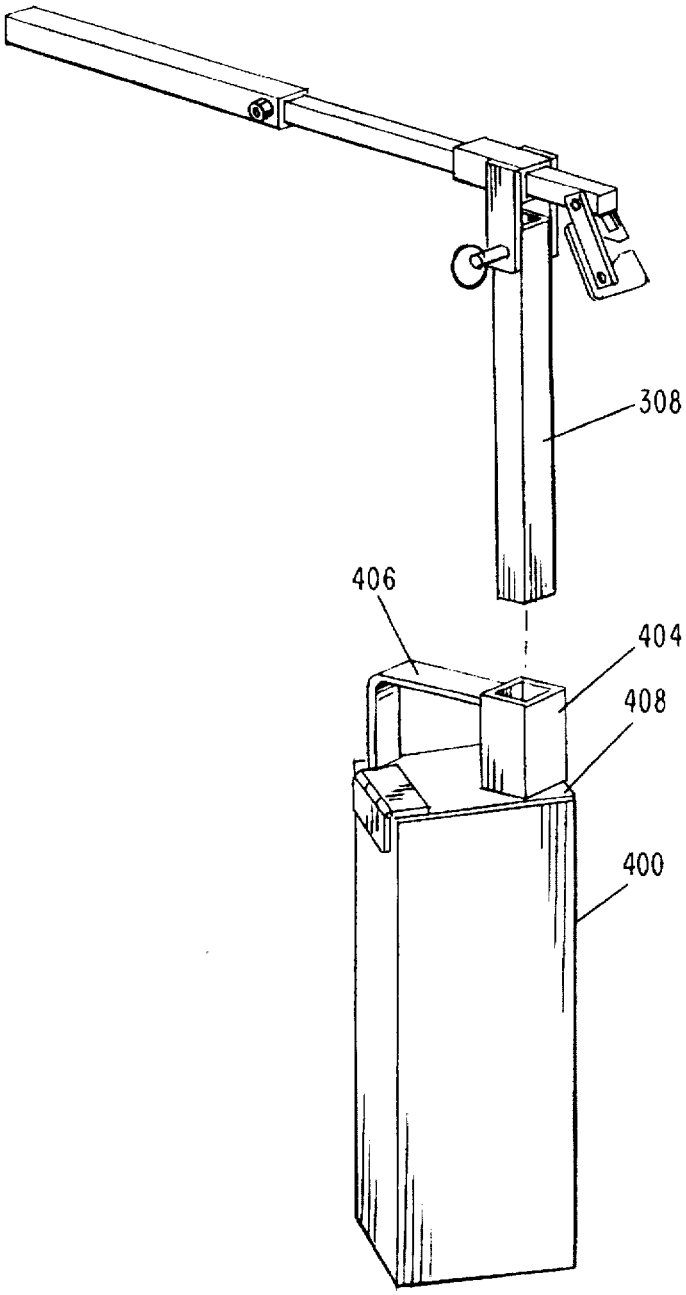
FIG. 16 is a perspective view of an alternative embodiment of the post puller using a carrying case as a base.
Figure 17:
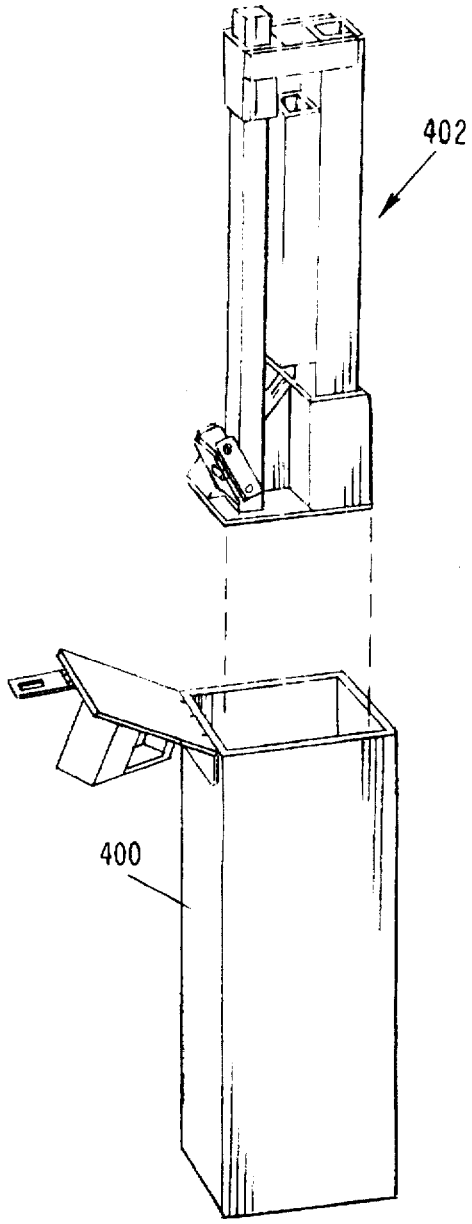
FIG. 17 is a perspective view of the embodiment of FIG. 16 illustrating placement of the post puller in its carrying case.

FIGS. 16 and 17 illustrate the preferred carrying case for transportation and storage of the preferred post/stake remover. Boxlike case 400 is preferably made of welded steel or similar material for durability. The height and width of boxlike case 400 is sufficient to insert post/stake remover 402 when folded up as shown in FIG. 17. In this manner all of the components can be placed within the boxlike case 400 in a small and efficient configuration. In addition to operating as a storage case, box-like covering 400 can also be used as a base for the post/stake remover as shown in FIG. 16. Hinged top plate 408 can have attached a top plate support base 404 as shown. Therefore, for extremely loose soil or for use when a taller base section is required, a user slides support riser 308 into top plate support base 404 and operates the post/stake remover 402 as previously disclosed. Handle 406 can be attached to hinged top plate 408 and top plate support base 404 as shown for carrying.

Figure 18:
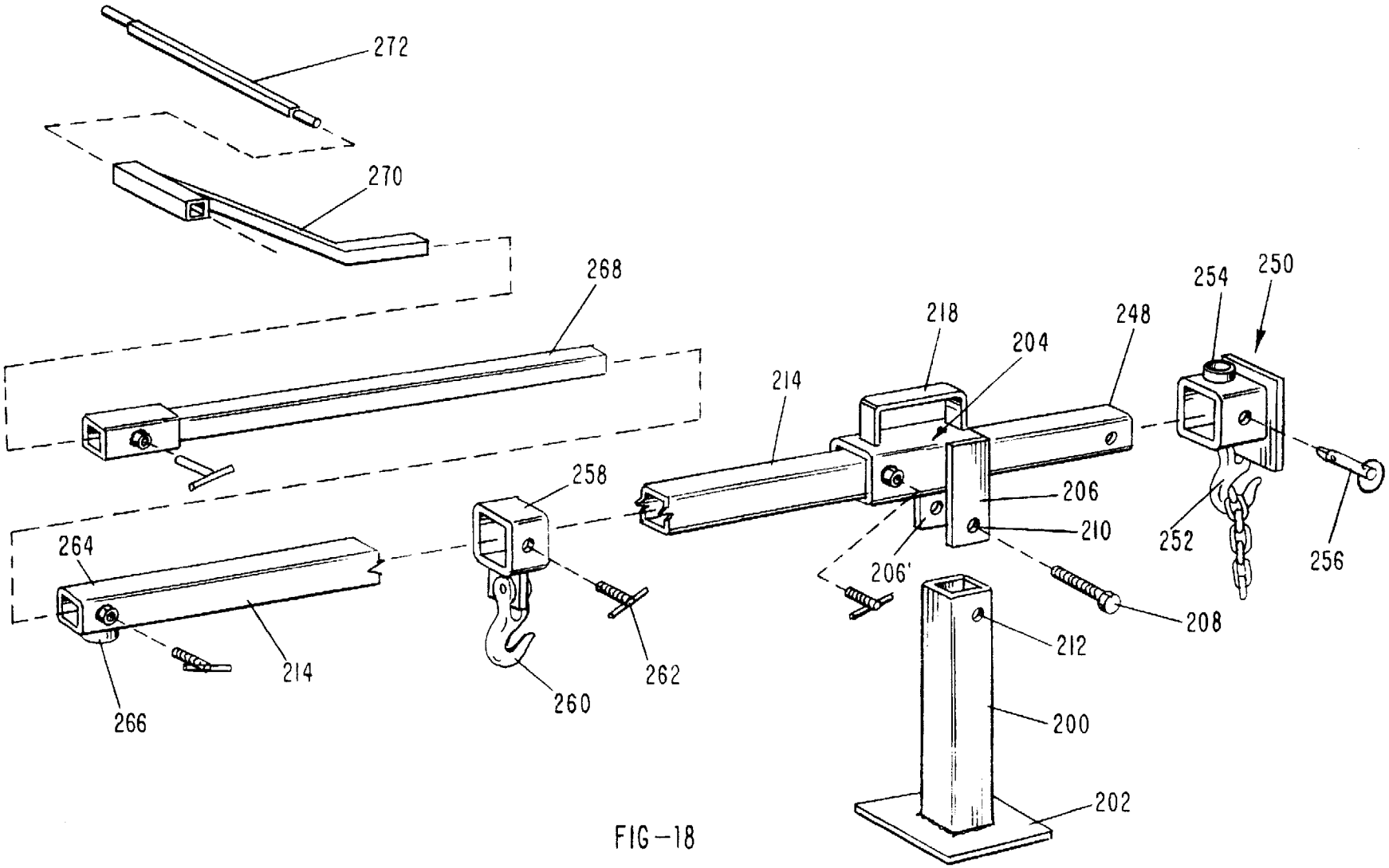
FIG. 18 is a perspective view of the preferred manhole removing tool of the present invention.

The preferred manhole cover removal tool or lifting apparatus is shown in FIGS. 18, 19, 20 and 21. FIG. 18 illustrates all the component parts of the invention. This embodiment comprises of stand 200, preferably with base plate 202 at the bottom end. Lever support member 204 is affixed to stand 200 by dual brackets 206 and 206' by bolt 208 through apertures 210 in dual brackets 206 and 206' and stand apertures 212 as shown. In this manner lever support member 204 can pivot on stand 200. A single bracket could also be utilized alternatively, however, the strength of this joint would be jeopardized (not shown). The height of stand 200 is preferably eighteen inches, however, different heights can be used depending on the preference of the user. Alternatively, a plurality of stand apertures 212 arranged vertically, could be used to vary the height of the lever support member 204 when affixed to stand 200 (not shown). Lever support member 204 is a tubular shaped member with a larger internal opening than the outside circumference of lever arm 214. Dual brackets 206 and 206' are affixed to the sides of lever support member 204 by welding or other known methods in the art. Lever arm stop 216 can be affixed to lever support member 204 to restrain lever arm 214 in the desired position. A screw type stop can be used as shown or apertures could be drilled in lever arm 214 and a spring loaded pin used as a stop for lever arm stop 216 (not shown). Additionally, handle 218 can be affixed to lever support member 204 to ease in transporting the apparatus.

Attached to first end 248 of lever arm 214 is combination hook and jacking apparatus 250, which consists of grappling device such as hook 252 on one end and jack receiving cup 254 on the opposite end. Hook and jacking apparatus 250 is restrained by restraining pin 256. Slid over lever arm 214 is hook bracket 258 with a second grappling device such as hook 260 attached as shown. Restraining screw 262 keeps hook bracket 258 from sliding when in use. Attached to second end 264 of lever arm 214 is second jack receiving cup 266. One or more extensions 268 can be added onto second end 264 for additional leverage. In addition, riser handle 270 can be used as an additional extender, and handle extension 272 can be inserted for additional room for handlers.

Figure 21:
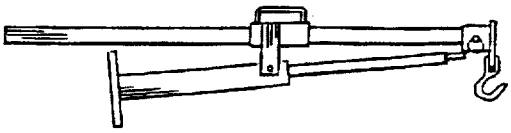
FIG. 21 illstrates th preferred manhole cover removing tool folded for storage or transportation.

Lever arm 214 is inserted in lever support member 204 so that when not restrained, lever arm 214 slides within lever support member 204, and extension 268 telescopically slides within lever arm 214 for compactability and ease of transport, as shown in FIG. 21.

Figure 19:
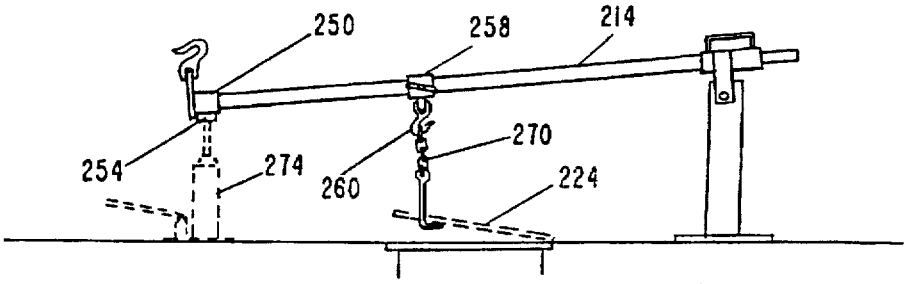
FIG. 19 illustrates the preferred manhole cover removing tool being used with a hydraulic jack.

In one embodiment as shown in FIG. 19, hook bracket 258 is slid over lever arm 214. Restraining screw 262 is tightened to temporarily immobilize it. A chain 270 is affixed to hook 260, which is then affixed by known means to the item to be lifted 224. Combination hook and jacking apparatus 250 is placed on lever arm 214 with jack receiving cup 254 facing down. Restraining pin 256 is inserted and a jacking device such as a hydraulic jack 274. Thus as the hydraulic jack 274 is activated, the item 224 is lifted. This embodiment is used for exceptionally heavy objects or for stuck manhole covers, or the like. In this embodiment, a second jack receiving cup 266, as shown in FIG. 18, can be affixed to second end 264, for a more universal apparatus.

Figure 20:
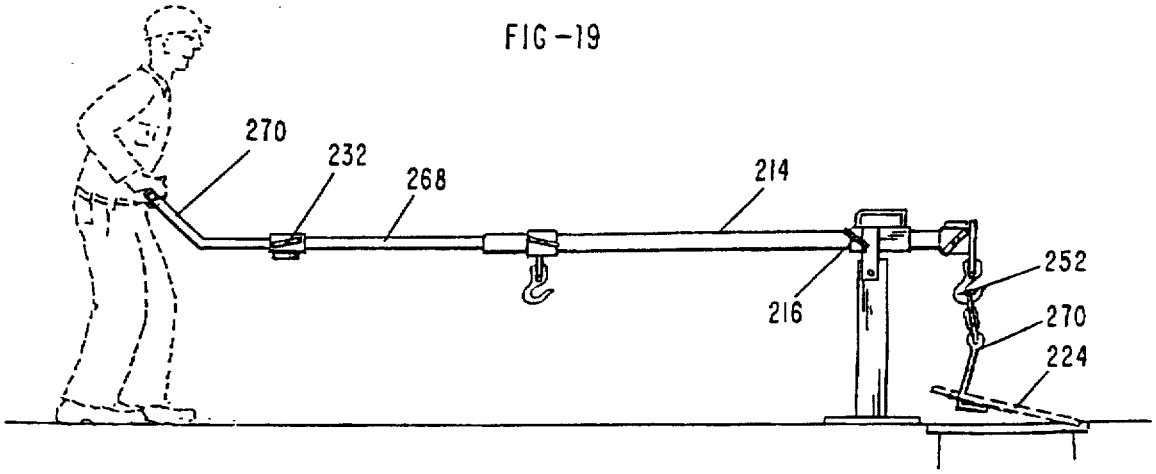
FIG. 20 illustrates the preferred manhole cover removig tool in operation.

In a second embodiment as shown in FIG. 20, the lifting apparatus for manhole cover removal or other item to be lifted 224, can be accomplished manually. A chain 270, is attached to hook or other grappling device 252, which is attached as shown to first end 248 of lever arm 214. Lever arm 214 is adjusted on lever support member 204 for optimal leverage, preferably adjacent to the item being lifted 224, and lever arm stop 216 engaged. Chain 270 is affixed to hook 252 and also to the item to be lifted 224. A lifting handle can be affixed to lever arm 214 (not shown). One or more telescoping extensions 268 can be added for additional leverage. Telescoping stops 232, preferably are used to adjust the length of the telescoped extension 268. Once the desired length of lever arm 214, with extensions 268, is achieved, the user pushes down on extension 268, which in turn lifts the item to be lifted 224. Lever arm 214 can also have an angled extension 270 attached to keep the user from having to bend over to lift the item to be lifted, as shown in FIG. 18.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. An apparatus for lifting manhole covers and other heavy items comprising:

a base;

a fulcrum support affixed to said base;

a fulcrum pivotably affixed to said fulcrum support;

an adjustable lever arm affixed to said fulcrum; and a combination hook and jack lifting head receiving means comprising a tubular member having a lifting hook on a first side and a jack lifting head receiving means on an opposite side, said tubular member removably affixed to a first end of said lever arm.

2. The invention of claim 1 wherein said adjustable lever arm is slidably insertable into said fulcrum.

3. The invention of claim 1 wherein said jack lifting head receiving means comprises a cup for receiving a hydraulic jack lifting head.

4. The invention of claim 1 further comprising a second jack lifting head receiving means affixed to a second end of said lever arm.

5. The invention of claim 1 further comprising at least one lever arm extension.

6. The invention of claim 5 wherein said at least one lever arm extension comprises a telescopic lever arm extension.

7. The invention of claim 1 further comprising a T handle affixed to said lever arm.

* * * * *